US010581197B2

(12) United States Patent
Wu et al.

(10) Patent No.: US 10,581,197 B2
(45) Date of Patent: Mar. 3, 2020

(54) PLUG CONNECTOR ASSEMBLY HAVING IMPROVED LOCKING STRUCTURE

(71) Applicant: FOXCONN INTERCONNECT TECHNOLOGY LIMITED, Grand Cayman (KY)

(72) Inventors: Jerry Wu, New Taipei, CA (US); Jun Chen, Kunshan (CN); Xiao Fan, Kunshan (CN); Zhi-Yong Zhou, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/817,320

(22) Filed: Nov. 20, 2017

(65) Prior Publication Data

US 2018/0145451 A1 May 24, 2018

(30) Foreign Application Priority Data

Nov. 23, 2016 (CN) ..... 2016 1 1040948

(51) Int. Cl.

| | |
|---|---|
| ***H01R 13/627*** | (2006.01) |
| ***H01R 12/71*** | (2011.01) |
| ***H01R 13/502*** | (2006.01) |
| ***H01R 13/635*** | (2006.01) |

(52) U.S. Cl.

CPC ..... *H01R 13/6273* (2013.01); *H01R 12/716* (2013.01); *H01R 13/502* (2013.01); *H01R 13/635* (2013.01)

(58) Field of Classification Search

CPC ..... H01R 13/6273; H01R 12/716; H01R 13/502; H01R 13/635; H01R 13/6275; H01R 13/6582; H01R 2107/00; H01R 24/60; H01R 24/20; H01R 13/506

USPC ..... 439/78, 345, 353, 354, 358

See application file for complete search history.

(56) References Cited

U.S. PATENT DOCUMENTS 4,469,394 A * 9/1984 Verhoeven ..... H01R 12/58 439/873

4,713,025 A * 12/1987 Soma ..... H01R 12/675 439/391

6,413,112 B2 * 7/2002 Semmeling ..... H01R 13/6275 439/357

(Continued)

*Primary Examiner* — Travis S Chambers

(74) *Attorney, Agent, or Firm* — Wei Te Chung; Ming Chieh Chang

(57) ABSTRACT

A plug connector assembly includes: a mating member including an insulative housing and a pair of latching members spacedly retained in the insulative housing; a cable electrically connected to the mating member; and an outer case enclosing the mating member and the cable and having an operating portion to operate the latching member; wherein each of the latching member includes a forwardly extending mounting portion, a connecting portion upwardly extending from a rear end of the mounting portion, an elastic portion upwardly extending form a top end of the connecting portion, and a locking portion disposed on an extremity end, the elastic portion defining an upwardly extending pressing portion, the operating portion when pressed further pressing the pressing portion to move the locking portion towards an inside of the insulative housing for disengaging the latching member from a mating connector.

17 Claims, 6 Drawing Sheets

(56) References Cited

U.S. PATENT DOCUMENTS

| | | | | |
|---|---|---|---|---|
| 6,948,965 | B2 * | 9/2005 | Kumamoto | H01R 13/6275 439/358 |
| 6,997,733 | B2 * | 2/2006 | Peng | H01R 13/6582 439/353 |
| 7,114,963 | B2 | 10/2006 | Shuey et al. | |
| 7,134,900 | B2 * | 11/2006 | Chung | H01R 13/6275 439/353 |
| 7,175,465 | B1 * | 2/2007 | Tsai | H01R 13/6275 439/352 |
| 7,314,383 | B1 * | 1/2008 | Ho | H01R 13/506 439/353 |
| 7,422,465 | B2 * | 9/2008 | Watanabe | H01R 13/6582 439/353 |
| 7,604,496 | B2 * | 10/2009 | Takeuchi | H01R 13/6275 439/358 |
| 8,100,709 | B2 * | 1/2012 | Zhang | H01R 13/6275 439/353 |
| 8,113,865 | B1 * | 2/2012 | Yang | H01R 13/4367 439/353 |
| 8,142,224 | B2 * | 3/2012 | Wu | H01R 13/648 439/353 |
| 8,556,648 | B2 * | 10/2013 | Wu | H01R 13/5213 439/276 |
| 2015/0288104 | A1 * | 10/2015 | Regnier | H01R 24/62 439/676 |
| 2016/0006143 | A1 * | 1/2016 | Chikusa | H01R 4/48 439/816 |

* cited by examiner

PLUG CONNECTOR ASSEMBLY HAVING IMPROVED LOCKING STRUCTURE

BACKGROUND OF THE INVENTION

1. Field of the Invention

The present invention relates generally to a plug connector assembly and more particularly to an improved locking structure for locking with a mating connector.

2. Description of Related Arts

U.S. Patent Application Publication No. 2015/0288104, published on Oct. 8, 2015, shows a plug connector assembly including a mating member, a cable electrically connected with the mating member, and an outer case enclosing the mating member and the cable. The mating member includes an insulative housing and a locking member assembled on the insulative housing. The locking member includes a flat base portion, a pair of connecting portions extended from the central portions of both sides of the base portion, a pair of elastic portions upwardly extending from upper ends of the connecting portions, and a pair of fixing portions forwardly and rearwardly extending from the sides of the base portion. Each of the elastic portions defines a locking portion on an end thereof and a pressing portion at a central position thereof. The outer case defines a handle portion arranged with the pressing portion to disengage the locking portions from a mating connector.

Since the latches of the prior art have a larger volume requiring more material to be manufactured, processing cost is increased and it is hard to miniaturize the product.

An improved locking structure in a plug connector assembly is desired.

SUMMARY OF THE INVENTION

An object of the present invention is to provide an improved locking structure for locking with a mating connector.

To achieve the above-mentioned object, a plug connector assembly comprises: a mating member including an insulative housing and a pair of latching members spacedly retained in the insulative housing; a cable electrically connected to the mating member; and an outer case enclosing the mating member and the cable and having an operating portion to operate the latching member; wherein each of the latching member includes a forwardly extending mounting portion, a connecting portion upwardly extending from a rear end of the mounting portion, an elastic portion upwardly extending form a top end of the connecting portion, and a locking portion disposed on an extremity end, the elastic portion defining an upwardly extending pressing portion, the operating portion when pressed further pressing the pressing portion to move the locking portion towards an inside of the insulative housing for disengaging the latching member from a mating connector.

DETAILED DESCRIPTION OF THE PREFERRED EMBODIMENT

Figure 1:
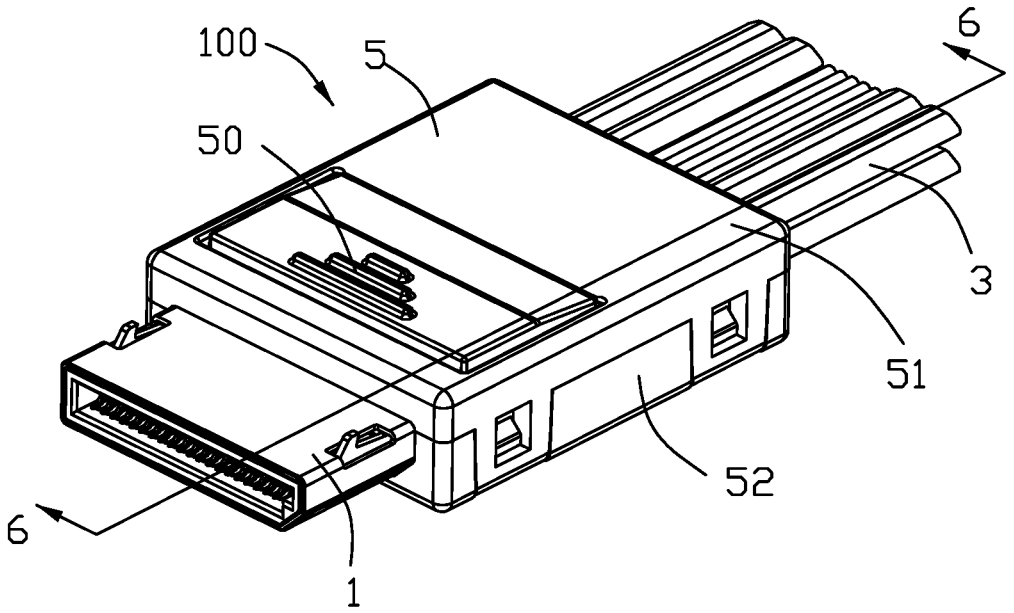
FIG. 1 is a perspective view of a plug connector assembly in accordance with the present invention.
Figure 2:
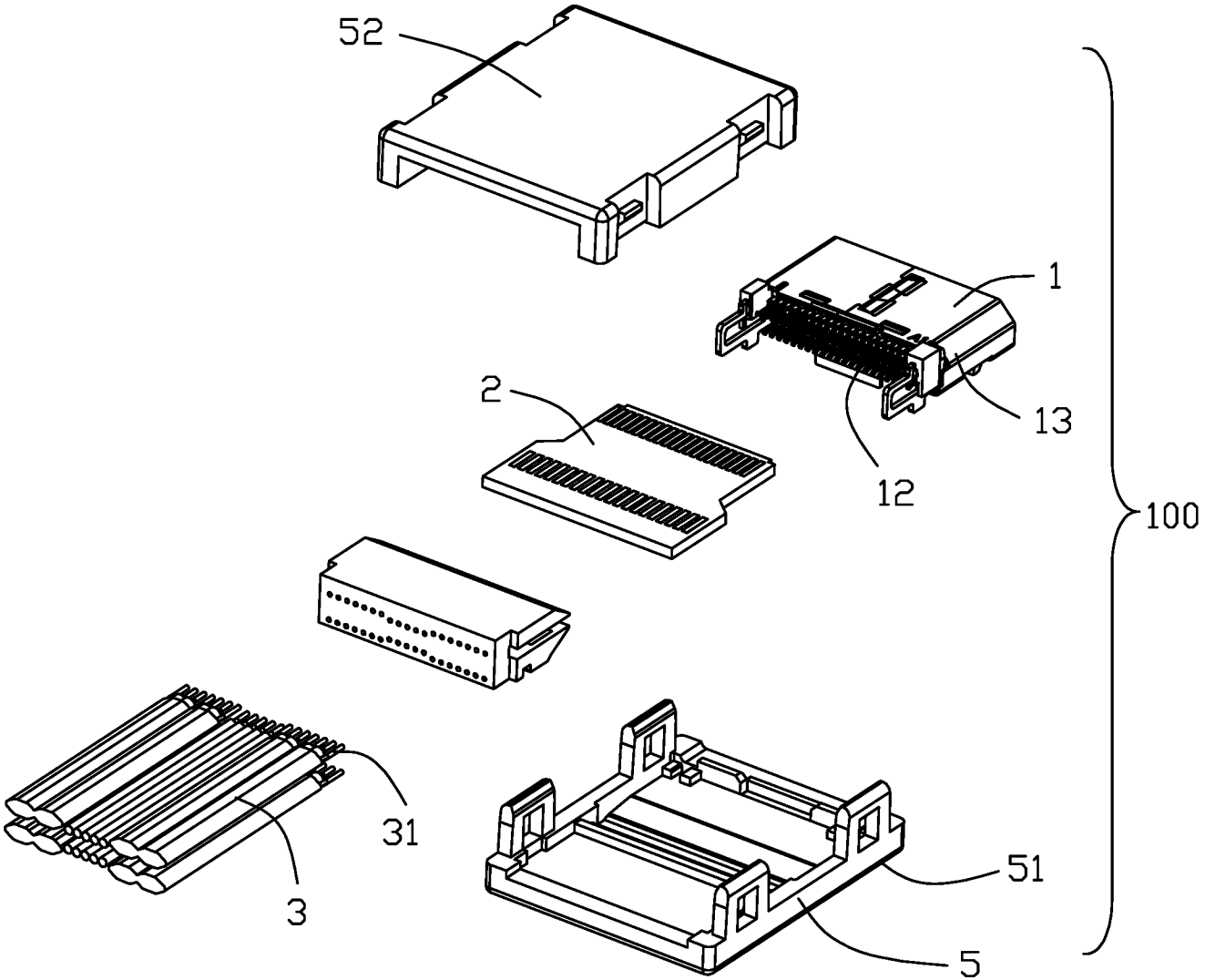
FIG. 2 is an exploded view of the plug connector assembly in FIG. 1.
Figure 3:
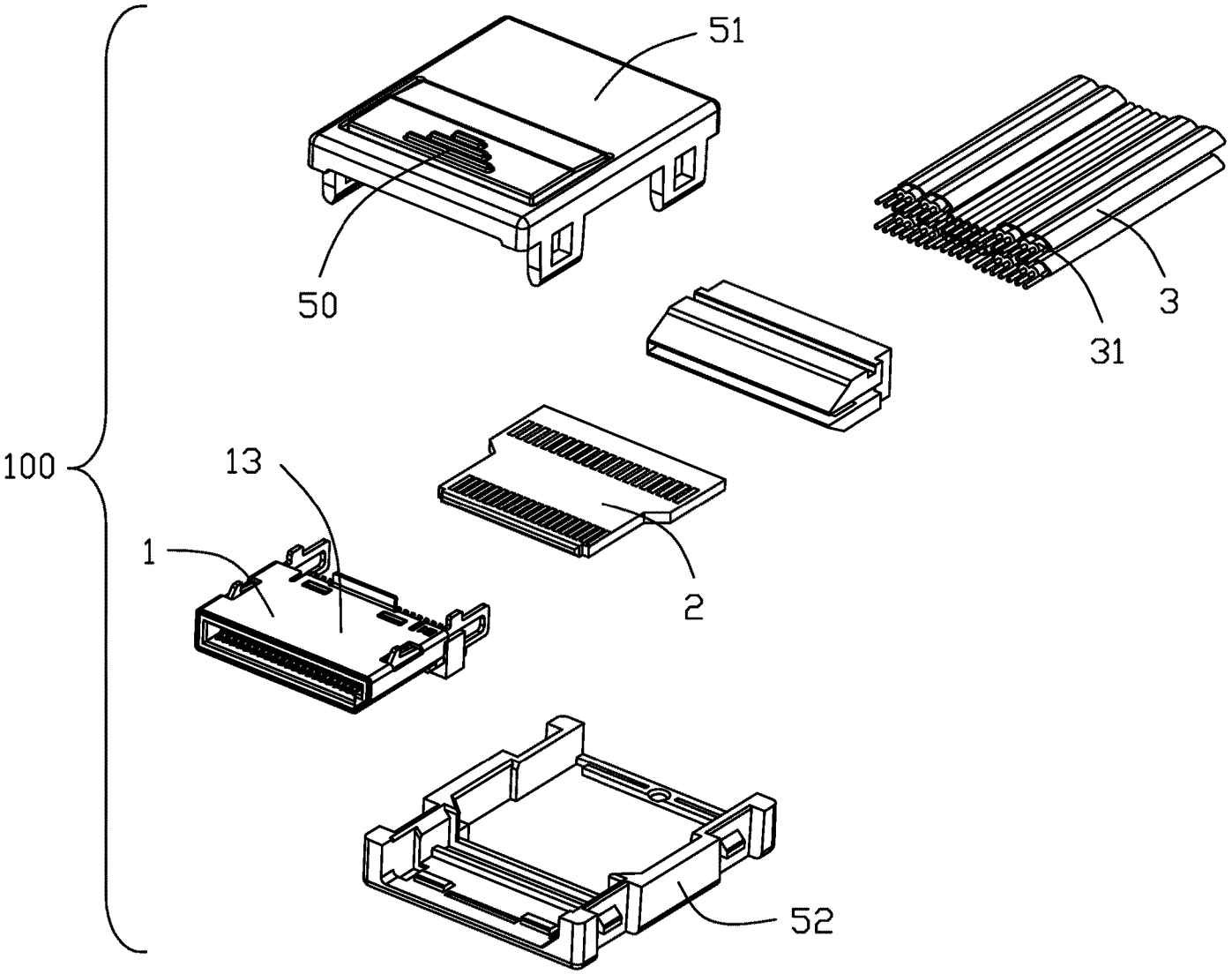
FIG. 3 is an exploded view similar to FIG. 2, but from a different aspect.

Referring to FIGS. 1 to 6, a plug connector assembly 100 in accordance with the present invention for latching with a mating connector (not shown), comprises a mating member 1, a printed circuit board 2 electrically connected to the mating member 1, a cable 3 electrically connected with the printed circuit board 2, a latching member 4 assembled on the mating member 1 for latching with the mating connector, and an outer case 5 enclosing the mating member 1 and the cable 3. An end of the printed circuit board 2 is connected to the meting member 1 and another end is connected to the cable 3. The cable 3 is a flat structure and includes a plurality of core wires 31.

The mating member 1 includes an insulative housing 11, a contacting module 12 retained in the insulative housing 11 and a metal case 13 enclosing the insulative housing 11. The insulative housing 11 defines a mating surface 111 on a front end thereof, an opposite mounting surface 111, a mating slot 112 inwardly extending from the mating surface 111, and a mounting slot 113 inwardly extending from the mounting surface 111 and communicating with the mating slot 112. The insulative housing 11 further includes a mounting plate 114 defining a plurality of engagement slot 115. The mating slot 112 includes a plurality of first contacting slots 1120 defined on a side thereof and a plurality of second contacting slots 1121 defined on another side thereof. The contacting module 12 is mounted into the insulative housing 11 from the mounting slot 113. The contacting module 12 includes a first contacting module 120 and a second contacting module 121. The first contacting module 120 includes a plurality of first contacts 1200 laterally spaced and a first insulative member 1201 enclosing the first contacts 1200. The second contacting module 121 includes a plurality of second contacts 1210 laterally spaced and a second insulative member 1211 enclosing the second contacts 1210. Both of the first insulative member 1201 and the second insulative member 1211 define a same engagement structure 123, for interference engaging the first insulative member 1201 with the second insulative member 1211, thus comminuted as a whole and integrally attached to the insulative housing 11.

More specifically, each engagement structure 123 includes a mounting projection 1230 and a mounting hollow 1231. The mounting projection 1230 disposed on the first insulative member 1201 is interference inserted into the corresponding mounting hollow 1231 disposed on the second insulative member 1211, and the mounting projection 1230 disposed on the second insulative member 1211 is interference inserted into the corresponding mounting hollow 1231 disposed on the first insulative member 1201, thus the first contacting module 120 and the second contacting module 121 are fixed and held together. Both of the first insulative member 1201 and the second insulative member 1211 define a pair of spaced engagement structures 123, and the mounting projection 1230 and the mounting hollow 1231 of each engagement structure 123 are connected together.

Both of the first insulative member 1201 and the second insulative member 1211 define a plurality of bumps 124 interference inserted into the corresponding engagement slots 115 of the mounting plate 114, to fix the contacting module 12 on the insulative housing 11. The engagement slots 115 of the mounting plate 114 are define on a same plane, and the bumps 124 of the first and the second insulative member 1201, 1211 are arranged in a row after the first insulative member 1201 is engaged with the second insulative member 1211. In the present embodiment, the first insulative member 1201 and the second insulative member 1211 are of same structure, thus the number of parts of the plug connector assembly 100 can be reduced and the assembly process of the plug connector assembly 100 can be reduced, so that the production cost of the plug connector assembly can be reduced.

Figure 4:
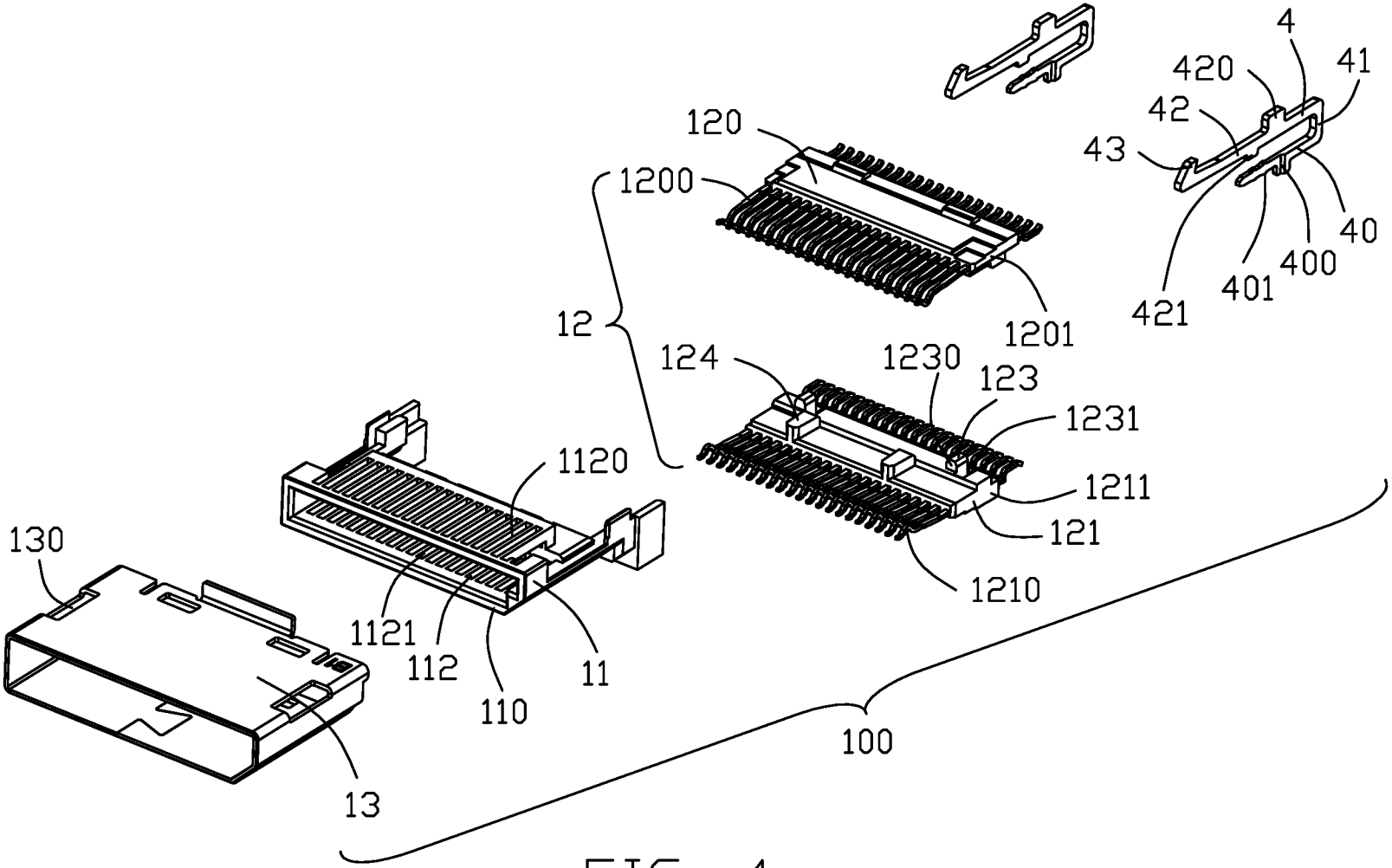
FIG. 4 is an exploded view of the mating member of the plug connector assembly in FIG. 1.
Figure 5:
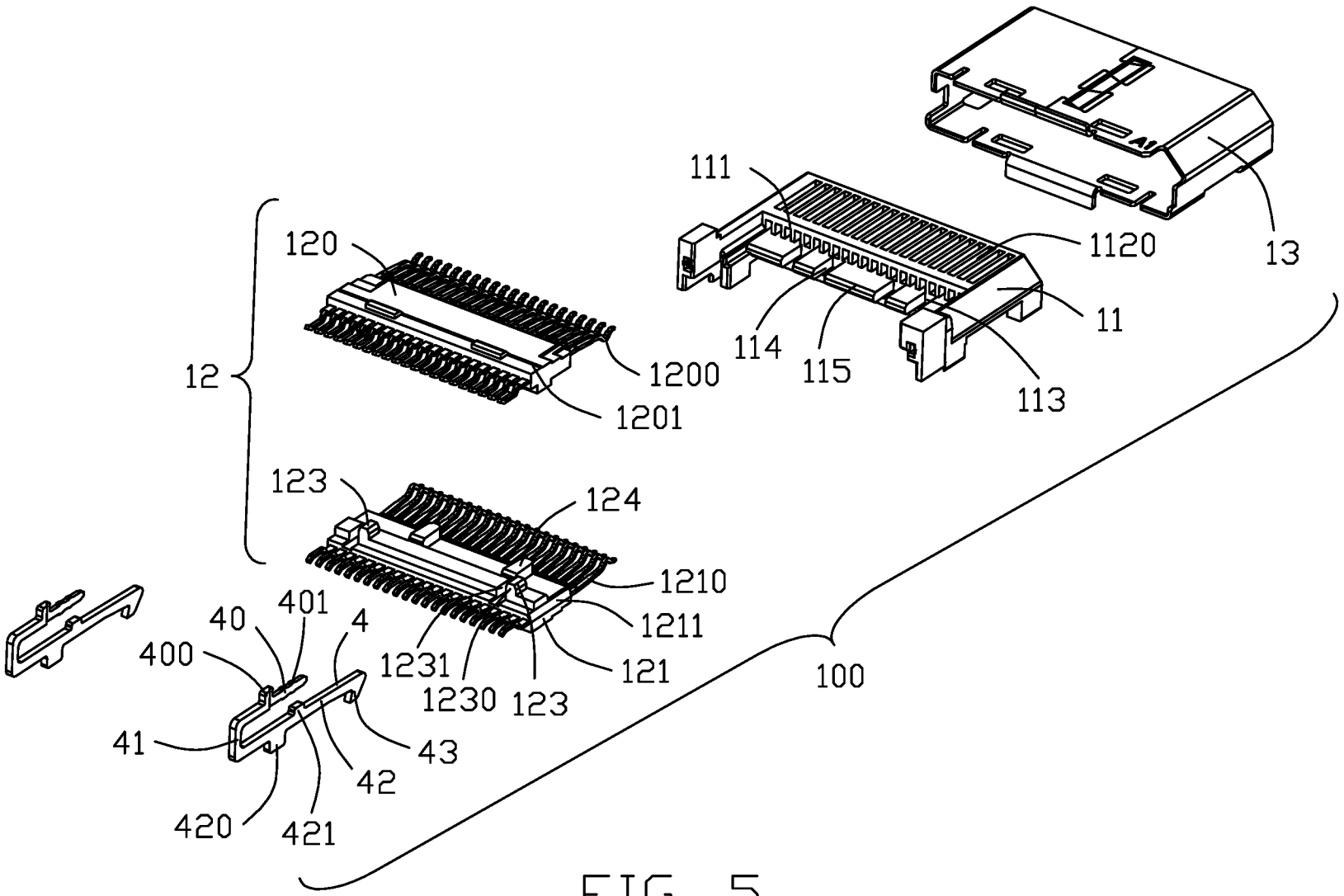
FIG. 5 is an exploded view similar to FIG. 4, but from a different aspect.
Figure 6:
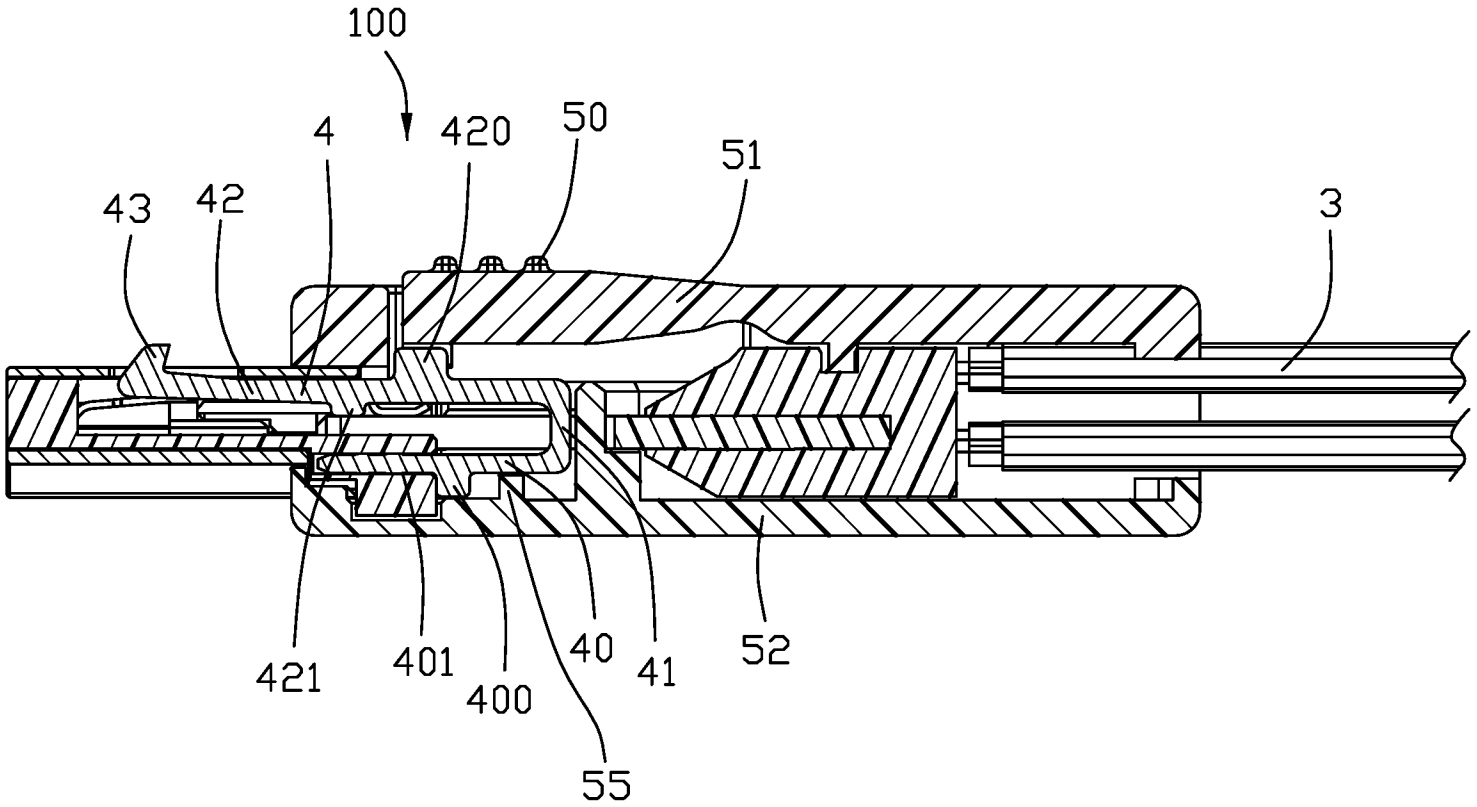
FIG. 6 is a sectional view of the plug connector assembly in FIG. 1, taken along line 6-6.

The metal case 13 surrounds the insulative housing 11, exposing the mating surface 110 and the mounting surface 111 to outside thereof. The metal case 13 defines a pair of through holes 130 spaced on a same side thereof. The latching members 4 are a pair and spaced mounted on the insulative housing 11. Each of the latching member 4 includes a mounting portion 40 forwardly extending, a connecting portion 41 upwardly extending from a rear end of the mounting portion 40, an elastic portion 42 forwardly extending from a top end of the connecting portion 41 and a locking portion 43 disposed on an extremity end of the elastic portion. The mounting portion 40 defines a stopping portion or a downward protrusion 400 downwardly extending there from to limit the depth of the latching member 4 inserted into the insulative housing 11. A barbed front section of the mounting portion 40 further defines a plurality of hangnails 401 to enhance the holding engagement of the mounting portion 40 with the insulating body 11. As shown in FIG. 4, the barbed front section of the mounting portion 40 is thinner than the rest of the latching member 4. The elastic portion 42 defines a pressing portion 420 upwardly extending there from, and a holding portion 421 deposed on a front side of the pressing portion 420 and downwardly extending from the pressing portion 420. The holding portion 421 prevents the elastic portion 42 from being overly pressed downwardly. The locking portions 43 are exposed through the corresponding through holes 130 to the outside of the metal case 13, for latching with the mating connector. The holding portion 421 is located between the locking portion 43 and the pressing portion 420 in the front-to-back direction, and is aligned with the barbed front section of the mounting portion 40 in the vertical direction perpendicular to the front-to-back direction for stabilization during downward deflection of the elastic portion 42.

The outer case 5 includes a first case 51 and a second case 52 engaging with the first case 51 by snap-in way. The outer case 5 defines an operating portion 50 for operating the pressing portion 420 of the latching member 4. Operators presses the operating portion 50 to press the pressing portion 420, and then the pressing portion 420 drives the locking portion 43 to move toward the inside of the insulative housing 11, further to disengage the latching with the mating connector. The operating portion 50 and the locking portion 43 are disposed on a same side of the mating member 1. The second case 52 forms an upward protrusion 55 upwardly supporting or abutting against the mounting portion 40 of the latching member 4. In opposite, the stopping portion or downward protrusion 200 downwardly abuts against the second case 52.

Compared to the prior art, the pair of latching members 4 of the plug connector assembly 100 of the present invention are provided as a pair of separate structures, i.e., without the need to connect the pair of latching member 4 together to a base portion, thereby resulting in a small volume and low manufacturing cost.

What is claimed is:

1. A plug connector assembly for latching with a mating connector, comprising:

a mating member including an insulative housing and a pair of latching members spacedly retained in the insulative housing;

a cable electrically connected to the mating member; and an outer case enclosing the mating member and the cable and having an operating portion to downwardly operate the latching member; wherein each of the latching members includes a forwardly extending mounting portion, a connecting portion upwardly extending from a rear end of the mounting portion, an elastic portion upwardly extending from a top end of the connecting portion, and a locking portion disposed on an extremity end, the elastic portion defining an upwardly extending pressing portion, the operating portion when pressed downwardly further pressing the pressing portion to move the locking portion towards an inside of the insulative housing for disengaging the latching member from a mating connector;

the elastic portion includes a holding portion downwardly extending therefrom for contacting an opposing portion of the insulative housing when the elastic portion is excessively pressed; and the mounting portion of each of said pair of latching members is supported by the outer case in a vertical direction.

2. The plug connector assembly as claimed in 1, wherein the outer case forms an upward protrusion to upwardly support the mounting portion.

3. The plug connector assembly as claimed in claim 1, wherein the holding portion is located between the locking portion and the pressing portion in a front-to-back direction.

4. The plug connector assembly as claimed in claim 1, wherein the mounting portion forms a downward protrusion downwardly pressing the outer case.

5. The plug connector assembly as claimed in claim 4, wherein said downward protrusion further forwardly abuts against the housing to limit a depth of the mounting portion inserted into the housing as a stopper.

6. The plug connector assembly as claimed in claim 5, wherein a front section of the mounting portion, which is received within the housing, is thinner than other portions of the latching member.

7. The plug connector assembly as claimed in claim 1, wherein the holding portion is aligned with a front section of the mounting portion in the vertical direction.

8. The plug connector assembly as claimed in claim 7, wherein said front section of the mounting portion is barbed.

9. A plug connector assembly for latching with a mating connector, comprising:

a mating member including an insulative housing and a pair of latching members spacedly retained in the insulative housing;

a cable electrically connected to the mating member; and an outer case enclosing the mating member and the cable and having an operating portion to downwardly operate the latching member; wherein each of the latching members includes a forwardly extending mounting portion, a connecting portion upwardly extending from a rear end of the mounting portion, an elastic portion upwardly extending from a top end of the connecting portion, and a locking portion disposed on an extremity end, the elastic portion defining an upwardly extending pressing portion, the operating portion, when pressed downwardly, further pressing the pressing portion to move the locking portion towards an inside of the insulative housing for disengaging the latching member from a mating connector; wherein the elastic portion includes a holding portion downwardly extending therefrom so as to prevent the elastic portion from being excessively downwardly pressed; wherein the holding portion is located between the locking portion and the pressing portion in a front-to-back direction; wherein the holding portion is aligned with a front section of the mounting portion in a vertical direction perpendicular to the front-to-back direction; and the outer case forms an upward protrusion to upwardly support the mounting portion.

10. The plug connector assembly as claimed in claim 9, wherein said front section of the mounting portion is barbed.

11. The plug connector assembly as claimed in claim 9, wherein in each of said latching member, the mounting portion is supported by the outer case in a vertical direction.

12. The plug connector assembly as claimed in claim 9, wherein the holding portion downwardly contacts an opposing portion of the housing when the elastic portion is about to be downwardly excessively pressed.

13. The plug connector assembly as claimed in claim 9, wherein the mounting portion forms a downward protrusion downwardly pressing the outer case.

14. The plug connector assembly as claimed in claim 13, wherein said downward protrusion further forwardly abuts against the housing to limit a depth of the mounting portion inserted into the housing as a stopper.

15. The plug connector assembly as claimed in claim 14, wherein a front section of the mounting portion, which is received within the housing, is thinner than other portions of the latching member.

16. A plug connector assembly for latching with a mating connector, comprising:

a mating member including an insulative housing and a pair of latching members spacedly retained in the insulative housing;

a cable electrically connected to the mating member; and an outer case enclosing the mating member and the cable and having an operating portion to downwardly operate the latching member; wherein each of the latching members includes a forwardly extending mounting portion, a connecting portion upwardly extending from a rear end of the mounting portion, an elastic portion upwardly extending from a top end of the connecting portion, and a locking portion disposed on an extremity end, the elastic portion defining an upwardly extending pressing portion, the operating portion when pressed downwardly further pressing the pressing portion to move the locking portion towards an inside of the insulative housing for disengaging the latching member from a mating connector;

the elastic portion includes a holding portion downwardly extending therefrom for contacting an opposing portion of the insulative housing when the elastic portion is excessively pressed;

the holding portion is located between the locking portion and the pressing portion in a front-to-back direction; and the holding portion is aligned with a front section of the mounting portion in a vertical direction perpendicular to the front-to-back direction.

17. The plug connector assembly as claimed in claim 16, wherein the mounting portion of each of said pair of latching members is supported by the outer case in a vertical direction.

* * * * *